US009533515B2

(12) United States Patent
Dumenil et al.

(10) Patent No.: US 9,533,515 B2
(45) Date of Patent: Jan. 3, 2017

(54) ASSEMBLY OF AT LEAST ONE REVOLUTION OBJECT AND ONE INK JET PRINTING MACHINE

(71) Applicant: MACHINES DUBUIT, Noisy le Grand (FR)

(72) Inventors: Francois Dumenil, Chaumes en Brie (FR); Jean-Louis Dubuit, Paris (FR)

(73) Assignee: MACHINES DUBUIT, Noisy le Grand (FR)

( * ) Notice: Subject to any disclaimer, the term of this patent is extended or adjusted under 35 U.S.C. 154(b) by 0 days.

(21) Appl. No.: 14/877,612

(22) Filed: Oct. 7, 2015

(65) Prior Publication Data

US 2016/0101631 A1 Apr. 14, 2016

(30) Foreign Application Priority Data

Oct. 10, 2014 (FR) ..... 14 59724

(51) Int. Cl.

| | |
|---|---|
| ***B41J 3/407*** | (2006.01) |
| ***B41J 2/01*** | (2006.01) |
| ***B41J 3/54*** | (2006.01) |
| *B41J 19/16* | (2006.01) |
| *B41J 25/00* | (2006.01) |
| *B41J 2/175* | (2006.01) |

(Continued)

(52) U.S. Cl.

CPC ..... *B41J 3/4073* (2013.01); *B41J 2/01* (2013.01); *B41J 3/543* (2013.01); *B41J 2/14* (2013.01); *B41J 2/17503* (2013.01); *B41J 2/2103* (2013.01); *B41J 19/16* (2013.01); *B41J 25/003* (2013.01)

(58) Field of Classification Search

None

See application file for complete search history.

(56) References Cited

U.S. PATENT DOCUMENTS

| | | | | |
|---|---|---|---|---|
| 9,199,343 | B2 * | 12/2015 | Perego | B23P 9/00 |
| 2012/0098914 | A1 | 4/2012 | Dubuit | |
| 2014/0028771 | A1 | 1/2014 | Yamada | |

FOREIGN PATENT DOCUMENTS

| | | | |
|---|---|---|---|
| FR | 10 58 717 | 3/1954 | |
| IT | EP 2179853 A1 * | 4/2010 | B41J 3/4073 |

* cited by examiner

*Primary Examiner* — Lisa M Solomon

(74) *Attorney, Agent, or Firm* — Davidson, Davidson & Kappel, LLC

(57) ABSTRACT

An assembly (1) of at least one object (5) having an outer surface (12) substantially of revolution around an axis of revolution (Δ) and a machine (10) for printing the object, the machine including: at least four printing stations (16, 18, 20, 22) including at least two inkjet printheads, each printhead defining a median plane, the median planes intercepting the outer surface along two impact axes, respectively, seen from an opening angle from the axis of revolution; a conveying system (35) including at least one object carrier (40) and suitable for moving the object carrier relative to the printing stations sequentially in at least four printing positions, the object carrier being suitable for rotating the object around the axis of revolution; and a controller. In each of the printing positions: the two printheads are offset relative to one another along the axis of revolution; the control system is configured so that said two printheads print the object during at least one printing period; and the median planes form an angle strictly smaller than the opening angle between them.

19 Claims, 5 Drawing Sheets

(51) Int. Cl.

| | |
|---|---|
| *B41J 2/21* | (2006.01) |
| *B41J 2/14* | (2006.01) |

ASSEMBLY OF AT LEAST ONE REVOLUTION OBJECT AND ONE INK JET PRINTING MACHINE

This claims the benefit of French Patent Application FR1459724, filed Oct. 10, 2014 and hereby incorporated by reference herein.

The present invention relates to an assembly of at least one object having an outer surface substantially of revolution around an axis of revolution and a machine for printing the object, the machine comprising:

at least four printing stations, each printing station including at least two inkjet printheads, each printhead defining a median plane, the median planes intersecting the outer surface along two impact axes, respectively, seen from an opening angle from the axis of revolution, a conveying system including at least one object carrier suitable for carrying the object, the conveying system being suitable for moving the object carrier relative to the printing stations sequentially in at least four printing positions in which the object is respectively across from one of the printing stations, the object carrier being suitable for rotating the object relative to the printing station around the axis of revolution in each of the printing positions, and a control system for controlling the conveying system and the printing stations.

The invention also relates to the corresponding method.

BACKGROUND

Most inkjet printheads have, for manufacturing reasons, a limited length, which limits the length of the printouts that can be done along the axis of revolution of the object to be printed.

An inkjet printhead comprises rows of nozzles on its lower face. The spacing between each nozzle is equal to the definition, in dots per inch (DPI).

The lower surface for example includes four rows of 90 nozzles each. The two outermost rows are for example spaced apart by 2.82 mm, while the nozzles in the four rows are spaced apart in pairs by 0.0705 mm, which leads to a definition of 360 DPI.

The length of a row of nozzles is for example approximately 72.1 mm. The width of the lower face is for example 17.2 mm.

The width of the lower face corresponds to the thickness of the printhead.

Thus, using a single printhead, by causing the object to be printed to pass below the printhead, it is possible to obtain a printout with a length of 72.121 mm.

In the event one wishes to print a flat object over extensions exceeding 72.121 mm in a transverse direction perpendicular to the movement direction of the object, it is known to place printheads behind one another in the transverse direction, such that the last nozzle of one of the heads is situated at 0.0705 mm from the first nozzle of the following head. As many printheads are used as are required by the extension of the printing, the printheads generally being placed in staggered rows to account for their thickness. In this position, the median planes of the printheads are separated from one another by at least the width of the lower face of the printheads, or 17.2 mm. In practice, the median planes are separated from one another by at least 22 mm to account for the supports of the printheads.

When this arrangement of the printheads in staggered rows is used to print on a revolution object, the object is rotated around its axis of revolution successively below each printhead, such that the entire revolution surface is successively presented in front of each printhead. Thus, if the printing station includes two printheads, the object to be printed performs at least two revolutions.

Added to the time necessary to perform those two revolutions is the time to transfer the object from one printhead to the other, over a distance of at least 22 mm. During that transfer, it also rotates the object such that the beginning of the printing happens at the second printhead.

To perform this printing, either the movement of the object is reversed during the transfer over 22 mm, or the object continues to be rotated at the same speed and in the same direction, which amounts to performing the 22 mm transfer at the same time as that necessary to perform another revolution. The second of these solutions is generally chosen, since the first solution involves significant decelerations and accelerations that may lead to slipping of the object relative to its object carrier, which is detrimental to the precision of the printing. Therefore in practice, the installation in staggered rows causes the object to perform three revolutions, and therefore decreases the printing pace by three.

In order to print revolution objects, it is possible to place the printheads of a same printing station in a radial configuration from the axis of revolution of the object, as described in document FR 10 58 717.

In this configuration, the median planes of the printheads pass through the axis of revolution of the object. The object is not moved from one printhead to the next in translation in the same printing station, which makes it possible to save time. However, the radial configuration of the printheads leads to increasing the separation between the printing stations. For example, to print on an object with a diameter of 40 mm, the distance between the printing stations goes from 22 mm to 75 mm.

Furthermore, the radial configuration of the printheads creates, at the object, a volume bulk that requires moving the object away from the printheads to bring it from one printing station to the next. It is generally considered that, for good definition of the printing, the distance between the lower face of a printhead and the object must be less than approximately 0.9 mm.

For example, if an object having a diameter of 40 mm is placed at 0.9 mm from the printheads of a printing station positioned radially, that object, after printing, must be transversely offset by approximately 5 mm during its movement toward the following printing station so as not to collide with the printheads that have just printed or those of the following printing station. Then, the object must be brought transversely closer to the following printing station to once again be situated at 0.9 mm from the printheads. This leads to additional transverse movements of the object, and therefore a reduction in the printing rhythm.

BRIEF SUMMARY OF THE INVENTION

It is an object of the present invention to offset all or part of the above drawbacks, by proposing an assembly of at least one object with an outer surface substantially of revolution and a machine for printing that object, the assembly having an improved printing rhythm.

The present invention provide an assembly as described above, wherein:

the two printheads of the station situated across from the object are offset relative to one another along the axis of revolution, the control system is configured so that said two printheads print the object during at least one printing period, and the median planes form an angle strictly smaller than the opening angle.

According to specific embodiments, the assembly comprises one or more of the following features, considered alone or according to all technically possible combinations:

the angle formed by the median planes is smaller than or equal to 80°, advantageously smaller than or equal to 50°, and still more advantageously smaller than or equal to 30°;

in each of the printing positions, the median planes of said two printheads of the printing station situated across from the object respectively form, with the outer surface, incidence angles greater than or equal to 65°, preferably greater than or equal to 75°;

in each of the printing positions, said incidence angles are substantially equal;

in each of the printing positions, at least one of said incidence angles is strictly smaller than 90°, for example less than or equal to 88°, and preferably less than or equal to 85°;

the conveying system is suitable for moving the object carrier relative to the printing stations along a trajectory that is, locally, at each printing station, substantially perpendicular to the median plane of one of the printheads of said printing station, preferably perpendicular to the median plane of the printhead closest to the object when the object carrier reaches the printing position corresponding to said printing station;

the assembly further comprises drying devices, each drying device being situated substantially opposite one of the printheads of one of the printing stations relative to the axis of revolution of the object when the object carrier is in the printing position corresponding to said station, each drying device preferably including at least one LED bar able to emit in the ultraviolet range, the bar preferably being substantially parallel to the axis of revolution, the control system is configured so that, in each printing position, the object rotates around the axis of revolution relative to the printing station corresponding to said printing position by one and a half revolutions;

each printing station comprises a stationary part relative to the object carrier when the object carrier is in the printing position corresponding to said printing station, and a part that is movable relative to the object carrier, the printheads of said printing station being secured to the moving part, the moving part being movable between a close position, in which the printheads are designed to print the object, and a separated position, in which the printheads are radially further from the object relative to the axis of revolution than in the close position;

the moving part is mounted rotating around a rotation axis relative to the stationary part, each printing station further including an actuating system to move the moving parts from the close position to the separated position, and vice versa, through a rotation of the moving part around the axis;

the actuating system comprises an off-centered member mounted rotating relative to the stationary part, a servomotor adapted to actuate the off-centered member, two crank pins mounted on the off-centered member, and at least one connecting rod mechanically connected to the crank pins and the moving parts;

the moving part comprises a bearing bracket movable relative to the stationary part, and a platen secured to the bearing bracket and bearing the printheads, the platen occupying an adjustable position relative to the bearing bracket to make each of the median planes substantially parallel to the axis of revolution of the object; and the object carrier being in any one of the printing positions, the control system is configured to move the moving part of the printing station corresponding to said printing position, the movement being done from the close position to the separated position and freeing a passage for the object when the object carrier leaves said printing position, the movement being done while the object has already rotated by at least 360° relative to said printing station and before the end of rotation of the object relative to the object carrier.

The invention also relates to a method for printing at least one object having an outer surface substantially of revolution around an axis of revolution, the method comprising the following steps:

providing a machine comprising at least four printing stations, a conveying system including at least one object carrier suitable for carrying the object, and a control system for controlling the conveying system and the printing stations, each printing station including at least two inkjet printheads, the two printheads being offset relative to one another along the axis of revolution, each printhead defining a median plane, the median planes intercepting the outer surface along two impact axes, respectively, seen from an opening angle from the axis of revolution, and the median planes forming an angle strictly smaller than or equal to the opening angle between them, moving the object carrier relative to the printing stations sequentially in at least four printing positions in which the object is respectively across from the printing stations, rotating the object relative to said printing station around the axis of revolution via the object carrier in each of the printing positions, and configuring the control system so that, in each printing position, the two printheads of the printing station situated across from the object print the object during at least the printing period.

BRIEF DESCRIPTION OF THE DRAWINGS

The invention will be better understood upon reading the following description, provided solely as an example and done in reference to the appended drawings, in which.

DETAILED DESCRIPTION

Figure 1:
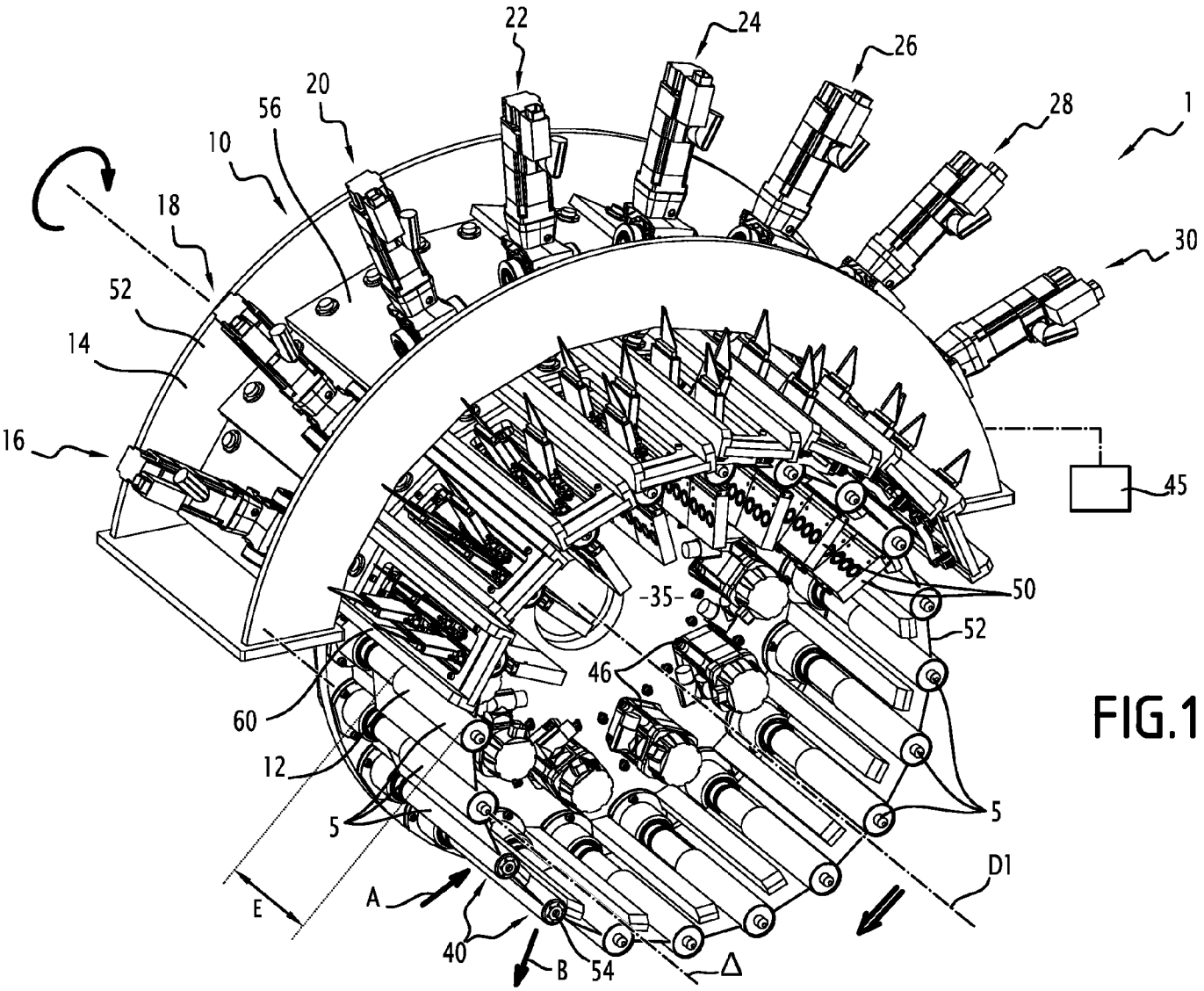
FIG. 1 is a perspective view of an assembly according to a first embodiment of the invention.
Figure 2:
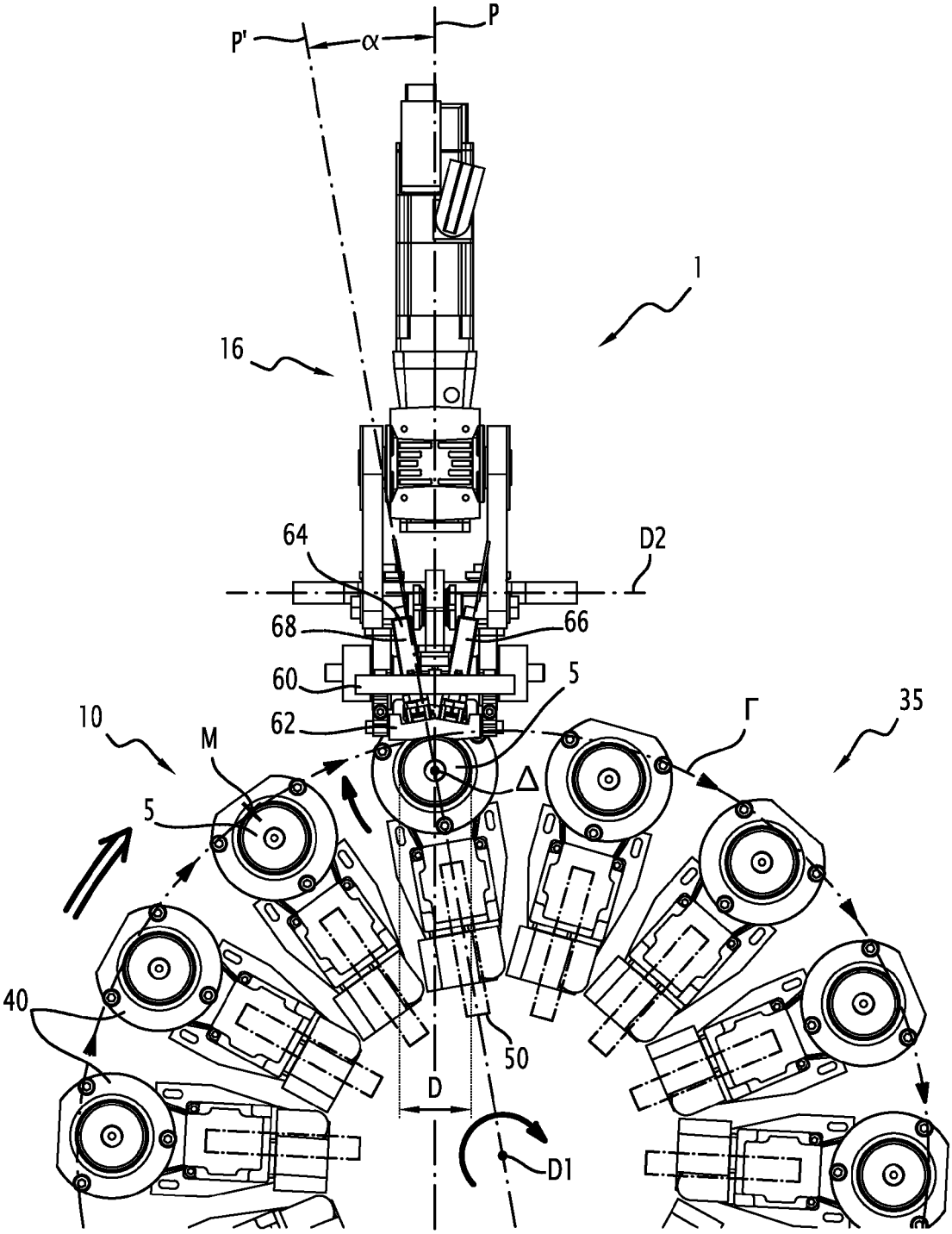
FIG. 2 is a partial front view of the assembly shown in FIG. 1.

An assembly 1 according to a first embodiment of the invention is described in reference to FIGS. 1 and 2.

The assembly 1 comprises a plurality of objects 5 to be printed, and a machine 10 for printing the objects 5.

The objects 5 are similar to one another. Each object 5 has an outer surface 12 substantially of revolution around an axis of revolution Δ. Each object 5 is for example a vial.

The outer surface 12 is for example substantially cylindrical. The outer surface 12 has a diameter D preferably greater than or equal to 40 mm, and an extension E along the axis of revolution Δ.

According to one alternative that is not shown, the outer surface 12 is substantially conical or frustoconical.

The extension E is strictly greater than 72 mm, i.e., in fact, as will be seen below, at the maximum printing extension EM1 allowed by a single printhead of the machine 10. For example, the extension E is strictly comprised between 1 and 3 times the maximum printing extension EM1.

The machine 10 comprises a housing 14, and a plurality of printing stations 16, 18, 20, 22, 24, 26, 28, 30 fixed on the housing 14. The machine 10 also comprises a conveying system 35 including a plurality of object carriers 40 respectively suitable for carrying the objects 5. The machine 10 further comprises a control system 45 for controlling the conveying system 35, the printing stations 16 to 30, and the object carriers 40. The machine 10 optionally includes a plurality of drying devices 50. The machine 10 also for example comprises loading and unloading stations for the objects 5 on the conveying system 35 that are known in themselves and not shown.

The housing 14 for example comprises an arc of circle structure 52 on which the printing stations 16 to 30 are substantially regularly angularly distributed.

The conveying system 35 is suitable for moving each object carrier 40 sequentially in printing positions in which the object 5 is respectively across from one of the printing stations 16 to 30.

The conveying system 35 is advantageously rotating, i.e., it comprises a tower 52 mounted rotating relative to the printing stations 16 to 30 around an axis D1 on which the object carriers 40 are fastened.

Figure 4:
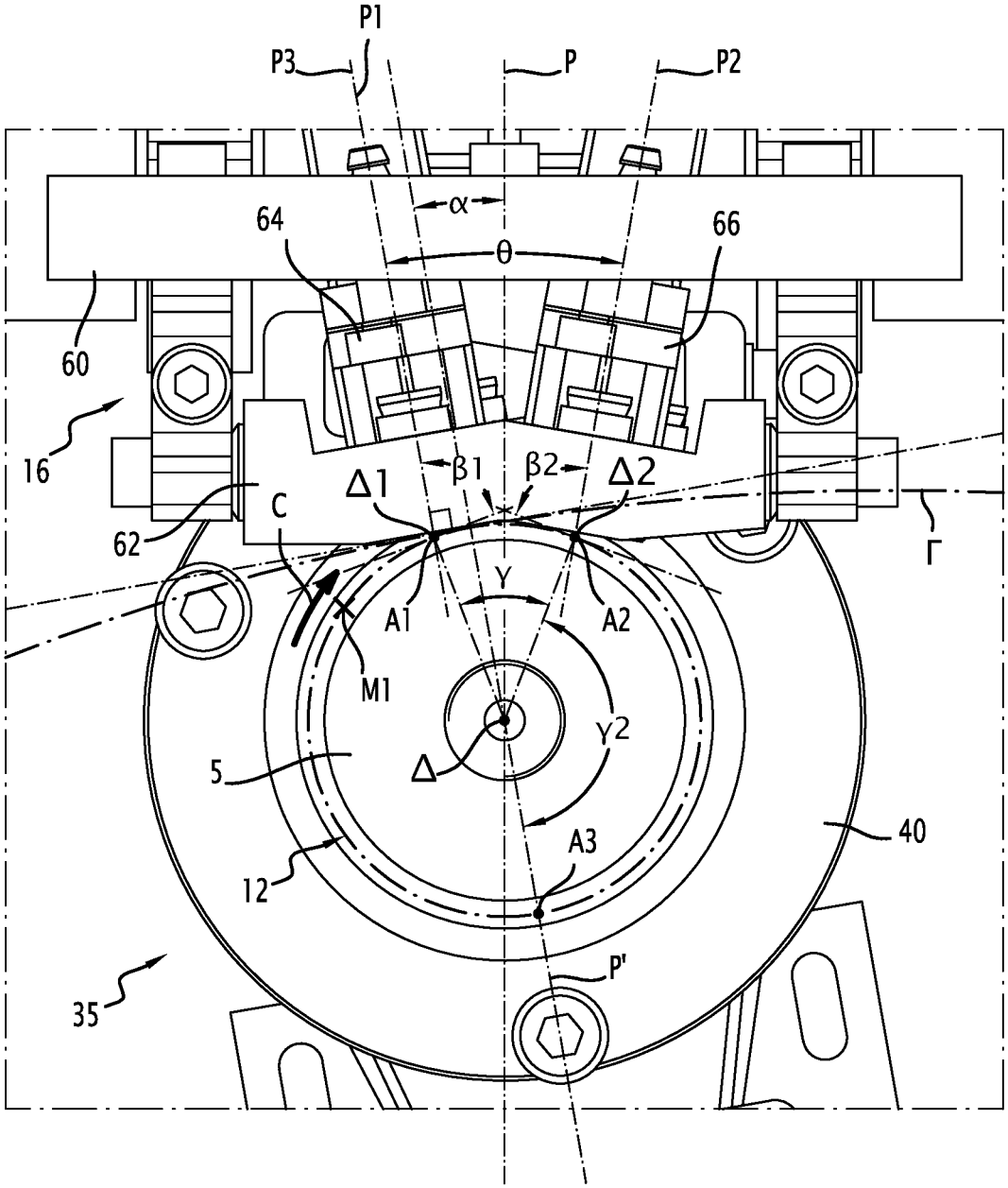
FIG. 4 is a partial front view showing the printheads of the printing station shown in FIG. 3, and the object to be printed.

The conveying system 35 is able to move the object carriers 40 along a substantially circular trajectory F (FIG. 4). The conveying system 35 is suitable for rotating in an indexed manner, so as to place each object carrier 40 successively in the printing positions corresponding to the printing stations 16 to 30.

The axis D1 is for example substantially horizontal.

The object carriers 40 are advantageously situated on the periphery of the rotating tower 52. Each object carrier 40 for example includes a mandrel 54 on which one of the objects 5 is respectively slipped.

The object carriers 40 are motorized by motors 46 controlled by the control system 45 to rotate the objects 5, respectively, synchronized with the conveying system 35.

The object carriers 40 are suitable for rotating the objects 5, selectively, relative to the printing stations 16 to 30 around the axis of revolution Δ in each of the printing positions.

According to one alternative that is not shown, the object carriers 40 do not include the mandrel 54, but a base-tip system making it possible to jam the objects 5.

Each member 54 for example extends substantially parallel to the axis D1. As a result, the axis of revolution Δ of the objects 5 is substantially parallel to the axis D1 when the objects 5 are supported by the object carriers 40.

According to one alternative that is not shown, the object carriers 40 are configured so that the axis of revolution Δ of the objects 5 forms a non-zero angle with the axis D1 when the objects 5 are carried by the object carriers.

There are at least four printing stations 16 to 30, so as to advantageously perform four-color printing on the objects 5. In the example shown in FIGS. 1 and 2, there are eight printing stations.

The printing stations 16, 18 are for example respectively able to deposit a layer of white ink on the objects 5.

The printing stations 20, 22, 24 are for example respectively able to deposit layers of cyan, magenta and yellow ink.

The printing station 26 is for example able to deposit a layer of black ink. The printing stations 28, 30 are for example able to deposit two layers of varnish.

The printing stations 16 to 30 being structurally similar to one another, only the printing station 16 will be described in detail below.

As shown in FIG. 2, the printing station 16 is positioned radially outside relative to the axis D1 with respect to the object 5 on which it is currently printing.

According to one alternative that is not shown, the printing station 16 is radially inside, i.e., it is located closer to the axis D1 than the object 5 is.

Figure 3:
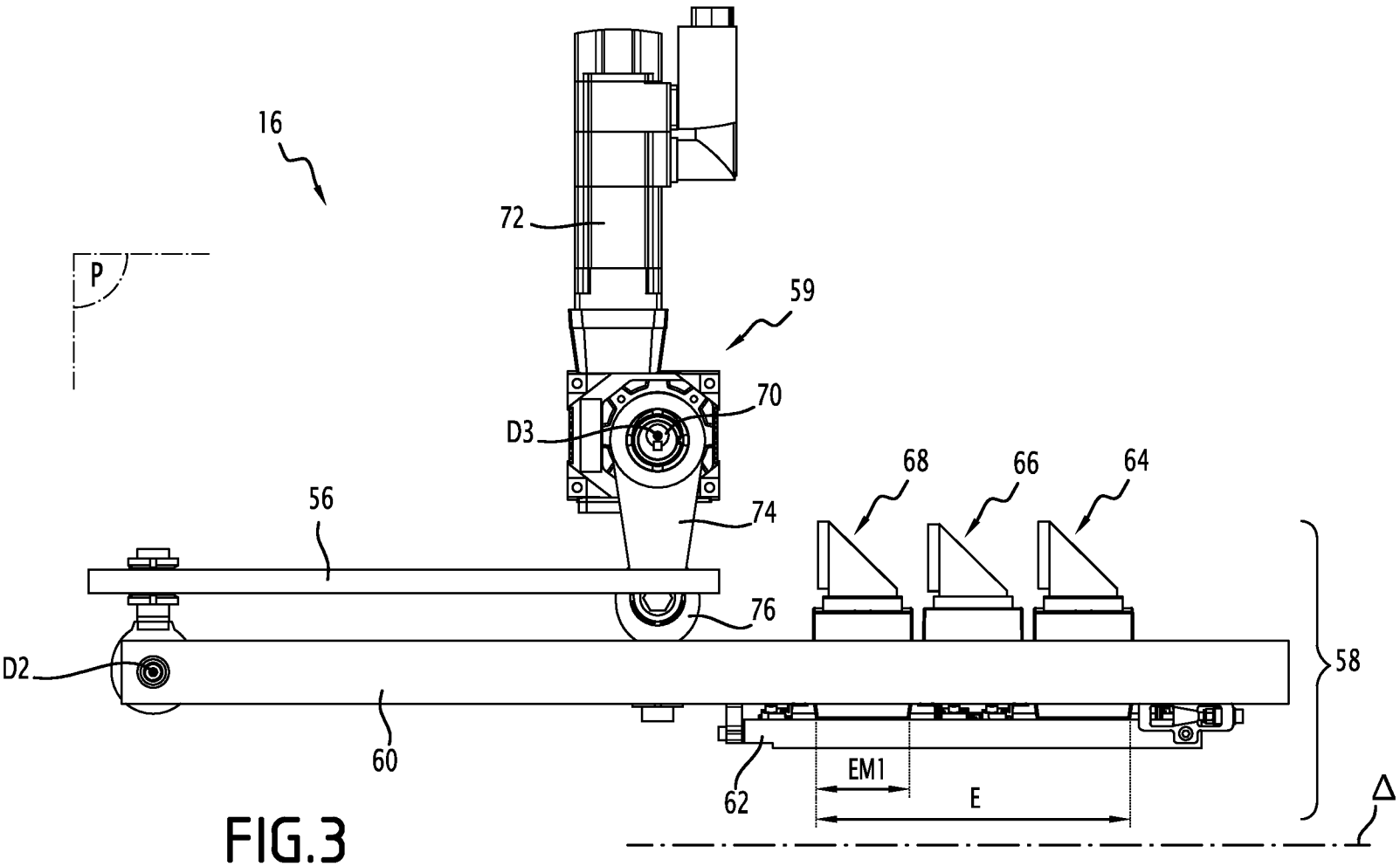
FIG. 3 is a side view of one of the printing stations shown in FIGS. 1 and 2.

As shown in FIG. 3, the printing station 16 comprises a stationary part 56 secured to the housing 14 (FIG. 1), a moving part 58 mounted rotating on the stationary part 56 around an axis D2, and an actuating system 59 to move the moving part relative to the stationary part.

The printing station 16 defines the median plane P, for example perpendicular to the axis D2.

The median plane P is substantially a plane of symmetry for the printing station 16. The median plane P advantageously passes through the axis of revolution Δ of the object 5.

The median plane P forms an angle α with a plane P' defined by the axis of revolution Δ and the axis D1.

The printing station 16 does not extend perfectly radially from the axis D1, but is permanently inclined toward the following printing station 18.

The angle α is advantageously less than 40°, and is approximately 15° in the described example.

The stationary part 56 for example has a generally planar shape for instance extending substantially perpendicular to the median plane P, advantageously substantially parallel to the axis of revolution Δ of the object 5 on which the printing station 16 is currently printing.

The moving part 58 comprises a bearing bracket 60 mounted rotating relative to the stationary part 56 around the axis D2, and a platen 62 mounted with an adjustable orientation relative to the bearing bracket 60 and for example bearing three inkjet printheads 64, 66, 68.

The moving part 58 is movable between a close position shown in FIGS. 2 to 4, in which the printheads 64, 66, 68 are close to the object 5 to be printed, and a position of the object 5 separated radially from the axis of revolution Δ.

The separated position is deduced from the close position by rotating the moving part 58 around the axis D2 in a direction moving the printheads 64, 66, 68 away from the object 5.

As shown in FIG. 3, the printheads 64, 66, 68 are offset relative to one another along the axis of revolution Δ.

The printheads 64, 66, 68 are advantageously structurally identical to one another.

Each of them is suitable for printing on the extension zone EM1 along the axis of revolution. Δ.

In the separated position, the printhead 66 is far enough away from the object 5, such that the latter can follow the trajectory Γ without colliding with the printhead 66.

The printheads 64, 66, 68 are offset such that they print over the entire extension E defined above.

The printheads 64, 66, 68 respectively define median planes P1, P2, P3 respectively extending perpendicular to the direction of the thickness of the printheads (FIG. 4).

Each printhead 64, 66, 68 includes rows of nozzles, the rows being substantially parallel, respectively, to the median plane P1, P2, P3.

Each printhead 64, 66, 68 is suitable for emitting jets of ink substantially parallel to the median planes P1, P2, P3, respectively.

The median planes P1, P2 intercept the outer surface 12, respectively, along two impact axes Δ1, Δ2 seen along an opening angle γ from the axis of revolution Δ.

The median planes P1, P2 of the printhead 64, 66 form an angle θ between them strictly smaller than the opening angle γ. This means that at least one of the median planes P1, P2 is not perpendicular to the outer surface 12.

The angle θ is for example less than or equal to 80°, advantageously less than or equal to 50°, and still more advantageously less than or equal to 30°.

The median plane P3 is advantageously substantially combined with the median plane P1.

According to an alternative that is not shown, in which the printing station 16 comprises more than three printheads, the latter alternate, their median planes sometimes being combined with the median plane P1, and other times with the median plane P2.

The median planes P1, P2 respectively form, with the outer surface 12, incidence angles β1, β2 greater than or equal to 65°, preferably greater than or equal to 75°.

The angles β1 and β2 are advantageously substantially equal, i.e., the median planes P1, P2 are substantially symmetrical relative to the median plane P. The angle α formed by the median plane P with the plane P' is advantageously chosen so that the median plane P1 is substantially perpendicular to the trajectory Γ of the object 5. In that case, the angle α is equal to half of the angle θ.

In the close position, the plane P1 being substantially perpendicular to the trajectory Γ, the printhead 64 is far enough away from the object 5 not too have the object collide with it when the object carrier reaches the printing position.

The nozzles of the printheads 64, 68 are suitable for spraying jets of ink on the outer surface 12 of the object 5 in a zone extending along the impact axis Δ1 and the outline of which is located around point A1 in FIG. 4. The printhead 66 is suitable for spraying jets of ink on the outer surface 12 in a zone extending along the impact axis Δ2 and the outline of which is situated around point A2 in FIG. 4. Points A1, A2 are spaced apart by an opening angle γ relative to the axis of revolution Δ.

Opposite the printhead 64, the plane P' intercepts the outer surface 12 along a straight line, the outline of which is point A3 in FIG. 4. Point A3 is situated across from one of the drying devices 50.

The actuating system 59 comprises an off-centered member 70 mounted rotating relative to the stationary part 56 around an axis D3, a servomotor 72 suitable for actuating the off-centered member, two crank pins 74 mounted on the off-centered member 70, and a connecting rod 76 mechanically connected to the crank pins and to the moving part 58.

Each drying device 50 is respectively situated substantially opposite the printhead 64 of one of the printing stations 16 to 30 relative to the axis of revolution Δ of the object 5 when the object carrier 40 is in the printing position corresponding to said printing station. Each drying device 50 advantageously comprises at least one LED (light emitting diode) bar able to emit in the ultraviolet range, for example between 365 and 405 nm.

The LED bar is for example substantially parallel to the axis of revolution Δ and has an extension substantially equal to the extension E along that axis.

Alternatively (not shown), the LED bar forms a non-zero angle with the axis of revolution Δ, for example to adapt to a conical outer surface 12.

The control system 45 is configured so that, in each printing position, the rotation of the object 5 around the axis of revolution Δ relative to the printing station 16 to 30 corresponds to said printing position, or for example substantially one and a half revolutions.

The control system 45 is further advantageously configured to move the moving part 58, the movement being done from the close position to the separated position, and vice versa. In the separated position, the printhead 66 is far enough away from the object 5, such that the latter can follow the trajectory Γ without colliding with the printhead 66.

The operation of the assembly 1 will now be described.

In reference to FIG. 1, the conveying system 35 is set in rotation relative to the printing stations 16 to 30 around the axis D1 in an indexed manner. The rotation is interrupted to place each object carrier 40 successively in all of the printing positions, i.e., successively across from all of the printing stations 16 to 30.

The objects 5 are loaded on the conveying system 35, for example at an arrow A, using the loading device (not shown).

After undergoing printing from each of the printing stations 16 to 30 and any other treatment through other treatment stations that are not shown, the objects 5 are unloaded from the conveying system 35, for example at arrow B.

In reference to FIG. 2, each object 5 is rotated relative to the printing stations 16 to 30 around the axis D1 so as to be successively parked below each printing station, as the object carrier 40 goes from one printing position to the next printing position.

When one of the object carriers 40 arrives below the printing station 16, the moving part 58 of the printing station (FIG. 3) is in the close position relative to the object 5. The printheads 64, 68 are then very close to the object 5, but do not constitute an obstacle, since the median planes P1, P3 are substantially perpendicular to the trajectory Γ followed by the zone of the outer surface 12 of the object 5 furthest from the axis D1.

The object carrier 40 remains parked across from the printing stations 16 throughout all of the printing by the latter on the object 5. The object carrier 40 sets the object 5 in rotation relative to the printing station 16 around the axis of revolution Δ, for example along arrow C (FIG. 4).

The printing by the printheads 64, 68 is done substantially in the zone embodied by point A1. The printing by the printhead 66 is done in the zone embodied by point A2. The drying is done by the closest drying device 50, primarily at a zone embodied by point A3.

Thus, in order to potentially print over the entire angular expanse of the outer surface 12 around the axis of revolution Δ using the printheads 64, 68, a point M1 of the outer surface must pass through the point A1 and perform a complete revolution to again pass through the point A1. For complete printing using the printhead 66, the point M1 next travels over the opening angle γ to again pass through point A2. In the illustrated example, point M1 has then traveled 360°+42°, i.e., a little over a complete revolution.

The printheads 64, 66, 68 partially simultaneously print the object 5 during a period that corresponds, in the described example, to the journey of point M1 between point A2 and point A1, passing through point A3.

Point M1, after having passed a first time through points A1 and A2, arrives at point A3, where the drying of the ink deposited by the printheads 64, 66, 68 at point M1 begins.

The printing by the printheads 64, 68 stops when point M1 once again passes through point A1. The printing by the printhead 66 stops when point M1 again passes through point A2.

The rotation of the object 5 continues until point M1 once again passes through point A3, which marks the end of the drying. The object 5 has then rotated by approximately one and a half revolutions, since point M1 has traveled the arcs of circles A1-A2, A2-A3, A3-A1, A1-A2 again, and A2-A3 again.

Since the printing strictly speaking on the outer surface 12 is complete when point M1 passes through point A2 again, the time elapsed during which point M1 passes from point A2 to point A3 is used to raise the moving part 58 of the printing station 16 from the close position to the separated position.

This frees a passage so that the object carrier 40 can pass to the following printing position, across from the printing station 18, without the object 5 colliding with the printhead 66.

It will be noted that the raising of the printheads from the close position to the separated position is not useful in all scenarios. Indeed, this depends on the dimensions of the printheads and the diameter D of the object 5.

For example, it is not useful to separate the printheads 64, 66, 68 from the object 5 when the latter has a very large diameter D, typically greater than 100 mm, and the angle θ formed by the median planes P1 and P2 is small. In that case, the lower faces of the printheads 64, 66, 68 tend to be more parallel to the trajectory Γ and do not hinder the passage of the object 5 toward the following printing station.

The passage of the moving part 58 from the close position to the separated position is obtained owing to the actuating system 59 (FIG. 3). The action of the system comprising the off-centered member 70, the crank pins 74 and the connecting rod 76 makes it possible to move the bearing bracket 60 and drive the moving part 58 in rotation around the axis D2 relative to the stationery part 56.

The moving part 58 is next placed back in the close position when the object carrier 40 is in transit between the printing position corresponding to the printing station 16 and that corresponding to the printing station 18. The object 5 is then already separated from the printheads 64, 66, 68 of the printing station 16.

When the object 5 arrives across from the printing station 18, the moving part 58 of the printing station 18 is already in the close position. The printing by the printing station 18 then begins similarly to that described above for the printing station 16.

Owing to the features described above, it is possible to print over the entire extension E of the object 5, while the extension E is greater than the maximum printing extension EM1 allowed by a single printhead.

The printheads 64, 66, 68 partially simultaneously printing the object 5, the printing on the object 5 is quick.

Furthermore, the median planes P1, P2 forming an angle θ between them smaller than or equal to 80°, the printheads 64, 66, 68 are closer to one another for a same diameter D of the object 5, and hinder the passage of the object 5 toward the following printing station less, or not at all. For the same reason, two successive printing stations are also closer. Thus, the printing rhythm is improved.

The optional feature according to which the incidence angles β1, β2 of the median planes P1, P2 are greater than or equal to 65° makes it possible to ensure perfect printing. The inventors have in fact discovered that these incidence angles β1, β2, which are characteristic of an average incidence of the jets of ink on the outer surface 12 of the object 5, do not need to be 90° to ensure good quality printing. Nevertheless, implementing this optional feature may prove difficult, in particular for objects 5 with a relatively small diameter D.

The optional feature according to which the incidence angles β1 and β2 are substantially equal makes it possible to distribute the deviations at the perpendicularity of the jets of ink relative to the outer surface 12 over all of the printheads of a same printing station.

The optional feature according to which the trajectory Γ of the object 5 is perpendicular to the median plane P1 makes it possible to leave the moving part 58 of the printing stations in the close position while the object carrier arrives in the printing position.

The optional presence of the drying devices 50 and their features make it possible to limit the rotation of the object 5 below each printing station to approximately one and a half revolutions.

The optional presence of the bearing bracket 60 and the adjustable platen 62 in the moving part 58 of the printing stations 16 to 30 allows a precise adjustment of the parallelism of the printheads 64, 66, 68 relative to the axis of revolution Δ of the object 5.

The optional passage of the moving part 58 from the close position to the separated position after printing on one of the objects 5, while the drying of that object is not yet complete, also makes it possible to save time.

Figure 5:
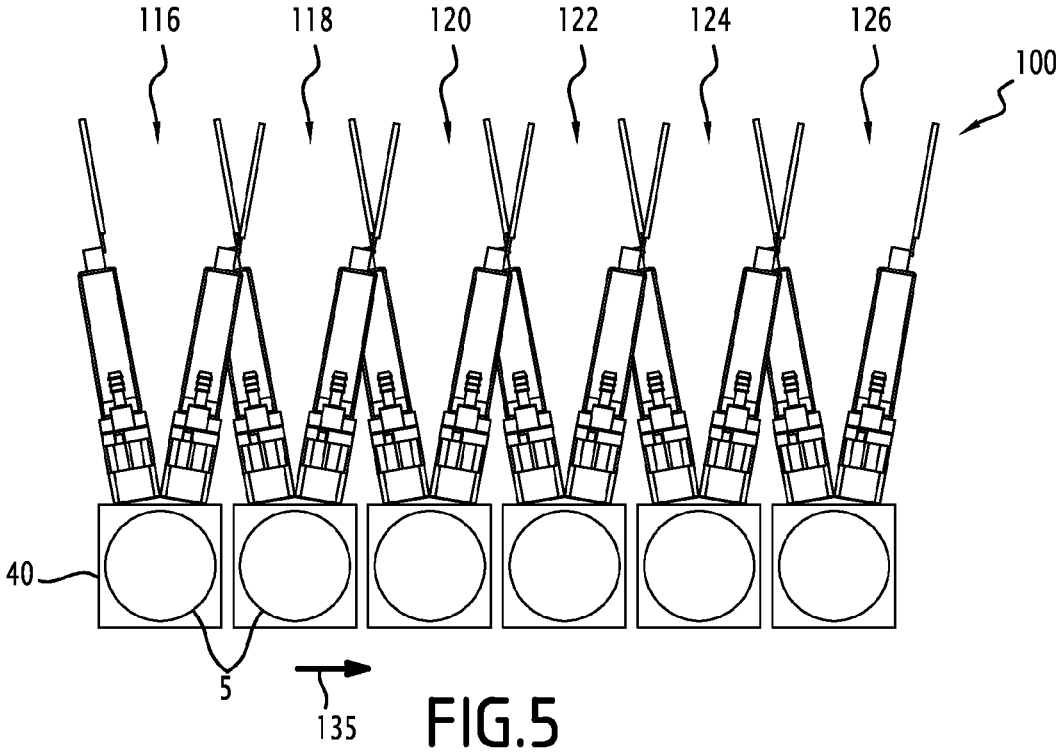
FIG. 5 is a diagrammatic front view of several printing stations of an assembly according to a second embodiment of the invention.
Figure 6:
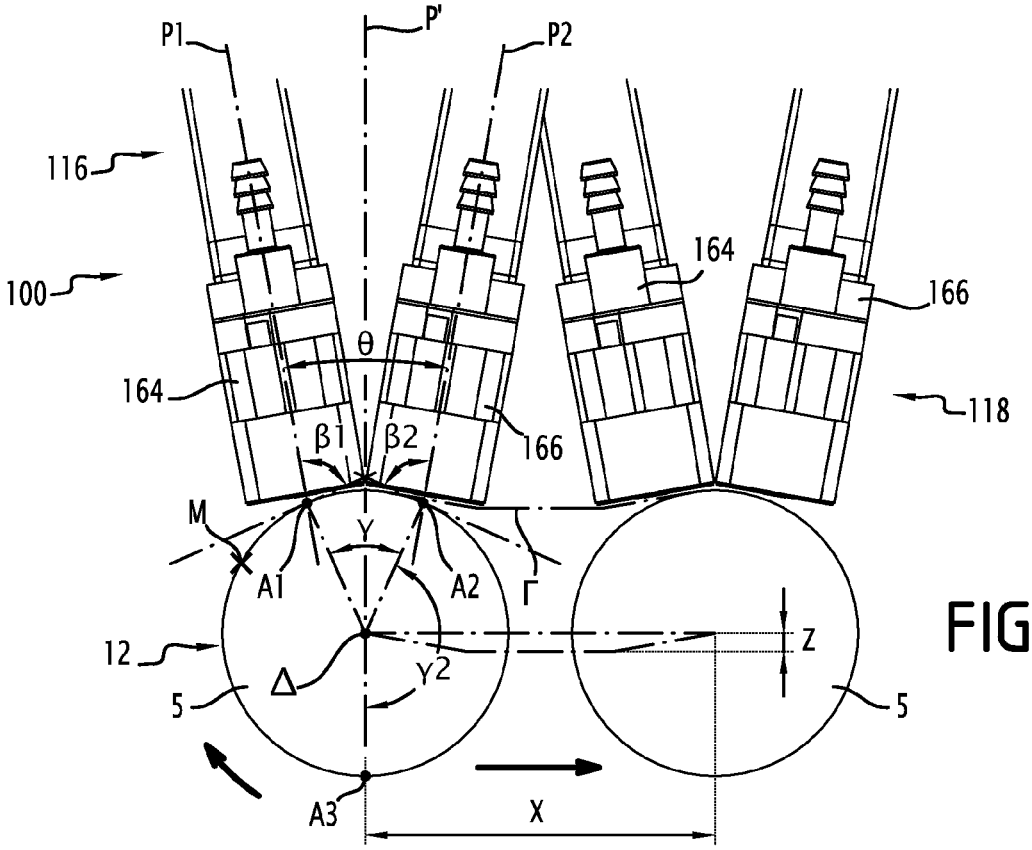
FIG. 6 is a partial front view of the printheads of two printing stations of the assembly shown in FIG. 5, and the object to be printed.

An assembly 100 according to a second embodiment of the invention is described in reference to FIGS. 5 and 6.

The assembly 100 is similar to the assembly 1 shown in FIGS. 1 and 4. The similar elements bear the same references in the figures and will not described again. Only the differences will be described in detail below.

The assembly 100 differs from the assembly 1 shown in FIGS. 1 to 4 in particular in that it includes a conveying system 135 that does not rotate, but instead is linear. Such a conveying system is known by those skilled in the art and will not be described in detail. The conveying system 135 for example comprises an endless belt transporting the object carriers 40.

The assembly 100 also comprises a plurality of printing stations 116, 118, 120, 122, 124, 126 positioned side-by-side and not on an arc of circle.

Each printing station 116 to 126 comprises printheads 164, 166, 168 similar to the printheads 64, 66, 68 of the assembly 1.

Two successive printing stations are separated by a center distance X equal to 50 mm in the illustrated example.

The printhead 164 of the printing station 118 and the printhead 166 of the printing station 116 overlap in the direction given by the axis of revolution Δ.

The plane P' is substantially perpendicular to the direction of advance of the object 5 when the object carrier 40 goes from one printing position to the next.

The median planes P1, P2 form an angle hof approximately 20°. The incidence angles β1 and β2 are equal to approximately 78°. The opening angle γ is equal to approximately 48°.

The printing stations 116 to 126 do not include moving parts making it possible to move the printheads away from the object 5.

The conveying system 135 is suitable for offsetting the object 5 by an extension Z in a direction substantially perpendicular to the axis of revolution Δ and contained in the plane P'. In the illustrated example, Z is equal to approximately 2.5 mm.

The operation of the assembly 100 is similar to the operation of the assembly 1.

The only noteworthy difference is that the printing stations 116 to 126 remain stationary while the object carrier 40 goes from one printing position to the next. The conveying device 135 translates the object 5 to separate it from the printheads by a value corresponding to the extension Z, so as to avoid contact between the object 5 and either of the printheads of each printing station.

Owing to the features described above, the center distance X is relatively small, which limits the transport time. The printing rhythm is improved as a result.

What is claimed is:

1. An assembly of at least one object having an outer surface of revolution around an axis of revolution and a machine for printing the object, the machine comprising:

at least four printing stations, each printing station including at least two inkjet printheads, each printhead defining a median plane, the median planes intersecting the outer surface along two impact axes, respectively, seen from an opening angle from the axis of revolution;

a conveying system including at least one object carrier suitable for carrying the object, the conveying system being suitable for moving the object carrier relative to the printing stations sequentially in at least four printing positions in which the object is respectively across from one of the printing stations, the object carrier being suitable for rotating the object relative to the printing station around the axis of revolution in each of the printing positions, and a controller for controlling the conveying system and the printing stations, wherein, in each of the printing positions:

the two printheads of the printing station situated across from the object are offset relative to one another along the axis of revolution, the controller is configured so that said two printheads print the object during at least one printing period, and the median planes form an angle strictly smaller than the opening angle.

2. The assembly as recited in claim 1 wherein the angle formed by the median planes is smaller than or equal to 80°.

3. The assembly as recited in claim 2 wherein the angle formed by the median planes is smaller than or equal to 50°.

4. The assembly as recited in claim 3 wherein the angle formed by the median planes is smaller than or equal to 30°.

5. The assembly as recited in claim 1 wherein in each of the printing positions, the median planes of said two printheads of the printing station situated across from the object respectively form, with the outer surface, incidence angles greater than or equal to 65°.

6. The assembly as recited in claim 5 wherein in each of the printing positions, said incidence angles are substantially equal.

7. The assembly as recited in claim 5 wherein in each of the printing positions, at least one of said incidence angles is strictly smaller than 90°.

8. The assembly as recited in claim 7 wherein in each of the printing positions, at least one of said incidence angles is strictly smaller than or equal to 88°.

9. The assembly as recited in claim 8 wherein a trajectory is locally, at each printing station, perpendicular to the median plane of the printhead closest to the object when the object carrier reaches the printing position corresponding to said printing station.

10. The assembly as recited in claim 1 wherein the conveying system is suitable for moving the object carrier relative to the printing stations along a trajectory that is, locally, at each printing station perpendicular to the median plane of one of the printheads of said printing station.

11. The assembly as recited in claim 1 further comprising drying devices, each drying device being situated substantially opposite one of the printheads of one of the printing stations relative to the axis of revolution of the object when the object carrier is in the printing position corresponding to said printing station.

12. The assembly as recited in claim 11 wherein each drying device includes at least one LED bar able to emit in the ultraviolet range.

13. The assembly as recited in claim 1 wherein the controller is configured so that, in each printing position, the object rotates around the axis of revolution relative to the printing station corresponding to said printing position by one and a half revolutions.

14. The assembly as recited in claim 1 wherein each printing station comprises a stationary part relative to the object carrier when the object carrier is in the printing position corresponding to said printing station, and a part that is movable relative to the object carrier, the printheads of said printing station being secured to the moving part, the moving part being movable between a close position, in which the printheads are designed to print the object, and a separated position, in which the printheads are radially further from the object relative to the axis of revolution than in the close position.

15. The assembly as recited in claim 14 wherein the moving part is rotatably mounted around a rotation axis relative to the stationary part, each printing station further including an actuating system to move the moving part from the close position to the separated position, and vice versa, through a rotation of the moving part around the axis.

16. The assembly as recited in claim 15 wherein the actuating system comprises an off-centered member rotatably mounted relative to the stationary part, a servomotor adapted to actuate the off-centered member, two crank pins mounted on the off-centered member, and at least one connecting rod mechanically connected to the crank pins and the moving parts.

17. The assembly as recited in claim 14 wherein the moving part comprises a bearing bracket movable relative to the stationary part, and a platen secured to the bearing bracket and bearing the printheads, the platen occupying an adjustable position relative to the bearing bracket to make each of the median planes substantially parallel to the axis of revolution of the object.

18. The assembly as recited in claim 14 wherein when the object carrier being in any one of the printing positions, the controller is configured to move the moving part of the printing station corresponding to said printing position, the movement being done from the close position to the separated position and freeing a passage for the object when the object carrier leaves said printing position, the movement being done while the object has already rotated by at least 360° relative to said printing station and before the end of rotation of the object relative to the object carrier.

19. A method for printing at least one object having an outer surface of revolution around an axis of revolution, the method comprising the following steps:

providing a machine comprising at least four printing stations, a conveyor including at least one object carrier suitable for carrying the object, and a controller for controlling the conveyor and the printing stations, each printing station including at least two inkjet printheads, the two printheads being offset relative to one another along the axis of revolution, each printhead defining a median plane, the median planes intercepting the outer surface along two impact axes, respectively, seen from an opening angle from the axis of revolution, and the median planes forming an angle strictly smaller than or equal to the opening angle between them;

moving the object carrier relative to the printing stations sequentially in at least four printing positions in which the object is respectively across from the printing stations;

rotating the object relative to said printing station around the axis of revolution via the object carrier in each of the printing positions, and configuring the controller so that, in each printing position, the two printheads of the printing station situated across from the object print the object during at least the printing period.

* * * * *